US012637923B2

(12) United States Patent
Henry et al.

(10) Patent No.: US 12,637,923 B2
(45) Date of Patent: May 26, 2026

(54) INSERT SUB-SURFACE SAFETY VALVE (SSSV) FOR USE IN COLD TEMPERATURE

(71) Applicant: Schlumberger Technology Corporation, Sugar Land, TX (US)

(72) Inventors: Jason Henry, Rosharon, TX (US); Garis McCutcheon, Houston, TX (US); Hai Hoang Nguyen, Rosharon, TX (US); Randy Royce Rowland, Rosharon, TX (US); Li Liu, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/293,865

(22) Filed: Aug. 7, 2025

(65) Prior Publication Data

US 2026/0043308 A1 Feb. 12, 2026

Related U.S. Application Data

(60) Provisional application No. 63/680,487, filed on Aug. 7, 2024.

(51) Int. Cl.
*E21B 34/10* (2006.01)
*E21B 41/00* (2006.01)

(52) U.S. Cl.
CPC ..... *E21B 34/10* (2013.01); *E21B 41/0064* (2013.01)

(58) Field of Classification Search
CPC ..... E21B 41/0064; E21B 43/164
See application file for complete search history.

(56) References Cited

U.S. PATENT DOCUMENTS

| | | | | |
|---|---|---|---|---|
| 3,006,149 | A * | 10/1961 | Reed | F17C 3/005 137/516.25 |
| 11,761,301 | B2 | 9/2023 | Fox | |
| 2012/0003043 | A1* | 1/2012 | Cawley | E21B 43/164 405/53 |
| 2021/0396109 | A1* | 12/2021 | Perreaux | E21B 43/166 |
| 2024/0392646 | A1* | 11/2024 | Gutterres | E21B 33/127 |

* cited by examiner

*Primary Examiner* — David Carroll
(74) *Attorney, Agent, or Firm* — Kyle R. Miiller

(57) ABSTRACT

A sub-surface safety valve (SSSV) for use in a low temperature downhole environment. The low temperature environment can be created by injection of fluid such as carbon dioxide. The low temperature downhole environment may be detrimental to the SSSV by damaging elastomer seals. The disclosed SSSV utilizes non-elastomeric seals and metal-to-metal seals between components. The SSSV utilizes metal-to-metal threads between body joints eliminating the need for an elastomers in the threads between body joints. Creating a SSSV with an elastomer seal reduces fatigue and damage in a low temperature environment.

20 Claims, 2 Drawing Sheets

INSERT SUB-SURFACE SAFETY VALVE (SSSV) FOR USE IN COLD TEMPERATURE

PRIORITY CLAIM/CROSS REFERENCE TO RELATED APPLICATIONS

Patent Document claims priority under 35 U.S.C. § 119 to U.S. Provisional App. Ser. No. 63/680,487, entitled Improvements for Multilateral Completion Systems", filed on Aug. 7, 2024, which is incorporated herein by reference in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Carbon capture and storage (CCS) involves injection of carbon dioxide ($CO_2$) into wells repurposed from depleted reservoirs or saline aquifers for long term storage. When constructing these wells, a wireline retrievable safety valve (WRSV) is installed in the tubing string to prevent the egress of $CO_2$ from the well in the event of downhole failures. In case of catastrophic failures to the well's integrity above the SSSV, the Joule-Thompson effect will cause rapid cooling of the tubing within the well to as low as −78° C. The low temperature may cause drastic changes to the material properties of the WRSV, as well as damage to its components. The use of a standard WRSV is challenging because the standard WRSV utilizes elastomeric seals in its piston and body connections, which may become brittle and easily damaged in a low temperature operating environment.

Therefore, there is a demand to provide an improved WRSV that is able to reliably operate in low temperature environments.

SUMMARY

The present disclosure relates to a method of using a WRSV for carbon capture by deploying a WRSV into a TRSV. Injecting carbon dioxide through the WRSV without damaging the WRSV because of the cold temperature environment during carbon capture. The WRSV has metal-to-metal seals or thermoplastic seals, as well as the metal threads. These seals and threaded connections are less likely to become brittle and break or crack under loading in extreme cold temperatures, unlike traditional WRSV with elastomer seals.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

A tubing retrievable safety valve (TRSV) is installed in a tubing string. The TRSV is designed to shut in a well in case of emergencies or uncontrolled flow and is a crucial component for well control and safety. When the TRSV fails, a WRSV is installed in the TRSV to maintain operation. The current embodiments of the WRSV have metal-to-metal seals and non-elastomeric seals that will maintain a seal when injecting $CO_2$ into a well. Additionally, the current embodiments of the WRSV may be installed in a functioning TRSV. A traditional functioning TRSV has elastomer seals that may be damaged due to the low temperature involved in $CO_2$ injection. Installing the current embodiments of the WRSV into functioning TRSV would bypass the use of the TRSV preventing downtime due to the failure of the seals in the TRSV.

Figure 1:
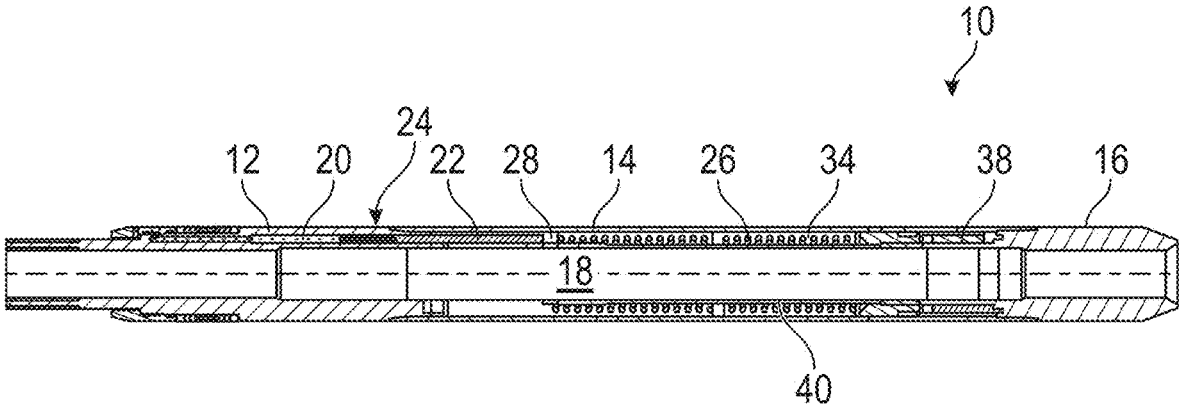
FIG. 1 illustrates a cross sectional view of an embodiment of a WRSV, according to one or more examples of the disclosure.

FIG. 1 is an illustration of a WRSV 10 for use in low temperature environments. The low temperature environment is created by injecting $CO_2$ in the formation for CCS. The housing sections of the WRSV 10 are threaded together, as shown in FIG. 1. The housing sections include a hydraulic chamber housing 12 coupled to a spring housing 14. The spring housing 14 is coupled to a nipple housing 16. The coupled housing sections have a throughbore 18 for the flow of fluid or other downhole tools. The WRSV 10 is connected to a wireline (not shown) and conveyed downhole and locked into a TRSV (not shown) with a traditional lock mandrel (not shown).

Figure 2:
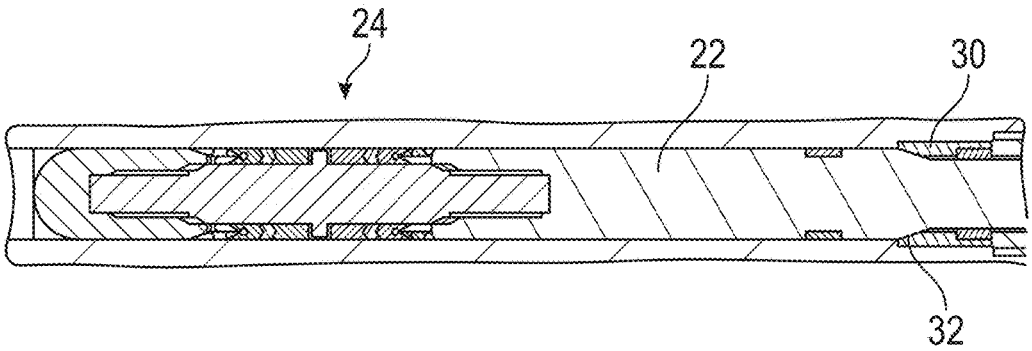
FIG. 2 illustrates an enlarged view of a cross sectional view of a piston assembly and down stop of the WRSV.

The hydraulic chamber housing 12 has a piston chamber 20. Within the piston chamber 20 is a piston 22. The piston 22 is movable within the chamber by hydraulic pressure. The lower end of the piston 22 is connected to an adapter 28. The adapter 28 separates the piston 22 from a spring 26 and allows the hydraulic force applied to the piston 22 to translate to the spring 26 causing the spring 26 to compress. The piston 22 has a seal assembly 24 that creates a seal between the inner surface of the chamber and the outer surface of the piston 22. FIG. 2 illustrates an enlarged view of a cross sectional view of the piston assembly. The seal assembly 24 has a plurality of seals. The seals can be a metal spring energized (MSE) seal and an MSE backup ring disposed adjacent to the MSE seal. The seal assembly 24 may comprise a plurality of assemblies 24. In the current embodiment, the seal assembly 24 utilizes a pair of the seal assemblies 24 arranged in opposite directions along piston 22 to provide a dual pressure seal configuration. The seal assemblies can avoid damage while injecting $CO_2$.

FIG. 2 also illustrates a seal created with a down stop 30 and a sloped surface 32 on the outer surface of the piston 22. The down stop 30 is a shoulder that stops the downward movement of the piston 22 through the piston chamber 20. The down stop 30 creates a static metal-to-metal seal between the down stop 30 and the outer surface of the piston 22. This metal-to-metal seal is a secondary seal. The secondary seal halts the downward movement of the piston 22 and enables a secondary sealing mechanism for the dynamic piston seals. Conventional WRSV may utilize an elastomeric down stop. The down stop in the conventional WRSV is subject to damage due to the cold temperature. The static metal-to-metal down stop 30 in the present embodiments does not become brittle and break or crack under loading in extreme cold temperatures, thus increasing the toughness and durability of the down stop 30. The metal-to-metal seal created with the down stop 30 and the sloped surface 32 of the piston 22 can reduce the cryogenically induced failures.

Referring back to FIG. 1, within the spring housing 14 is the spring 26 positioned in a spring chamber 34. The spring 26 abuts an upper stop ring at the up hole end and a lower stop ring at the down hole end within the chamber of the spring housing 14. The adapter 28 is connected to a movable flow tube 40. The flow tube 40 causes a flapper 38 for the TRSV. The flapper 38 is a hinged mechanism that controls flow through the TRSV. Hydraulic pressure acting on the piston 22 causes the piston 22 to move the flow tube 40. The flow tube 40 will push the flapper 38 open. When pressure is released, the flow tube 40 will move away from the flapper 38 and the spring 26 will close the flapper 38.

Figure 3:
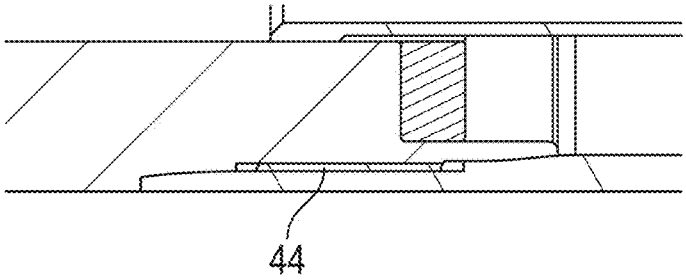
FIG. 3 illustrates a metal-to-metal premium thread for embodiments of the WRSV, according to one or more examples of the disclosure.

The TRSV may further comprise a metal-to-metal premium thread 44 for connecting body joints of the valve, as illustrated in FIG. 3. The usage of the metal-to-metal premium threads 44 eliminates the need for elastomers, which have inferior performance in temperatures below −17° C. In a further embodiment, the metal-to-metal premium threads 44 are torqued to eliminate the need for set screws or locking pins to prevent backing off of the body joint connections.

Figure 4:
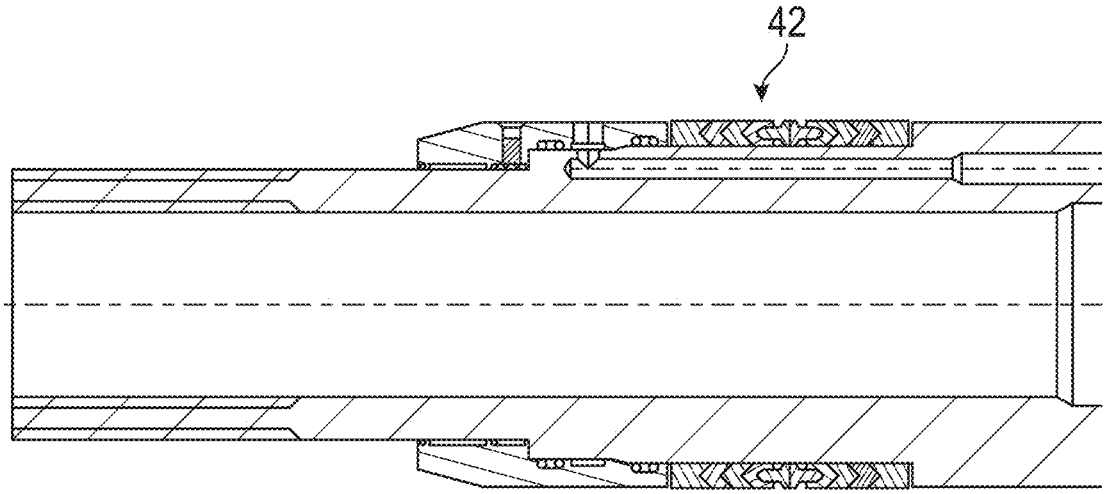
FIG. 4 illustrates a non-elastomeric packing on a hydraulic piston housing for embodiments of the WRSV, according to one or more examples of the disclosure.

On the outer surface of the hydraulic chamber housing 12 is a seal stack 42. Traditionally a seal stack has elastomeric seals that create a seal between the outer diameter of the WRSV 10 and the inner diameter of a landing nipple or polished bore of the TRSV. Elastomeric seals are not suitable for low temperature downhole environments. In the current embodiment, the seal stack 42 has a non-elastomeric seal between an upper seal section and a lower seal section as illustrated in FIG. 4. In one or more embodiments, the non-elastomeric packing may be metal-to-metal seals, or thermoplastic seals. FIG. 4 illustrates one seal stack 42 however, there may be more than one seal stack 42 located at various outer location of the housing.

Figure 5:
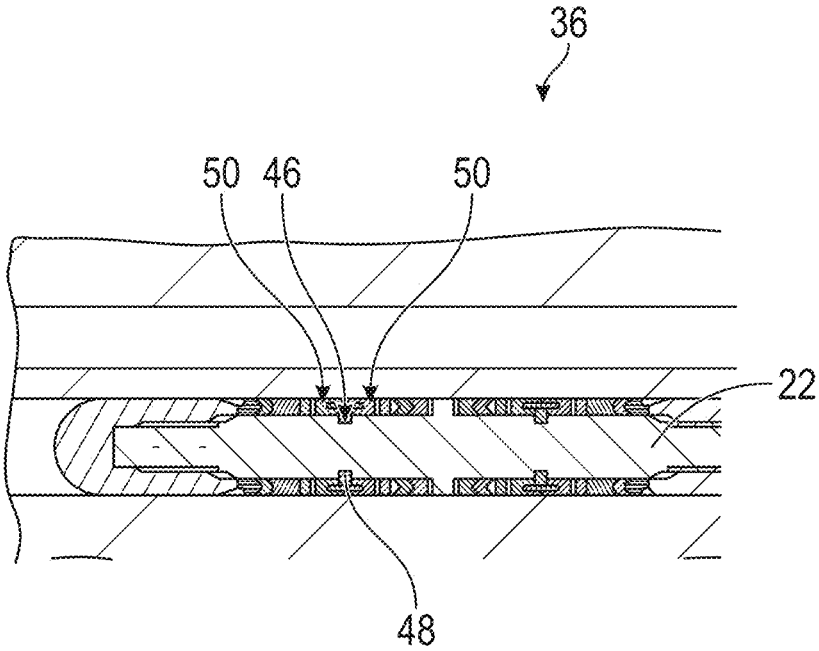
FIG. 5 illustrates a non-elastomeric packing on a piston assembly for the WRSV with non-elastomeric piston seals, according to one or more examples of the disclosure.

FIG. 5 illustrates another embodiment of seal assembly 36 associated with the piston 22. This embodiment the seal assembly 36 has the same MSE seal and an MSE backup ring as disclosed in FIG. 2. Additionally, the seal assembly 36 has a load transfer assembly positioned between opposite facing MSE seals. The load transfer assembly has a load ring 46 engaged in a groove 48 on the outer surface of the piston 22 to transfer loading piston. The load transfer assembly also has C-rings 50. A retaining sleeve holds the load ring 46 and C-ring 50 in place for the purpose of restricting movement of the load ring.

In operation, the WRSV is conveyed downhole by a wireline. The WRSV is connected to an inner surface of the TRSV. The inner surface may be a landing nipple or polished bore. The WRSV is actuated by hydraulic fluid causing the piston 22 to move downhole. The piston 22 is coupled to an adapter 28. The adapter 28 connects the piston 22 to the flow tube 40 and spring 26. As the piston 22 moves downward, the flow tube 40 will move downward while pushing the flapper 38 to an open position. While the piston 22 and flow tube 40 are moving downward, the spring is compressed. Now that the flapper 38 is in an open position, fluid can be injected through the bore of the WRSV. The fluid is carbon dioxide. The carbon dioxide can create a cold downhole environment that will damage seals in the WRSV. The WRSV has a threaded connection 44 without an elastomer seal. Additionally, the seal around the piston 22 is made from metal sealing elements. The down stop 30 and piston 22 create a metal-to-metal seal. Last, the seal stack 42 on the outer surface of the housing is made from metal-to-metal seals or thermoplastic seals. These metal-to-metal seals or thermoplastic seals, as well as the metal threads are less likely to become brittle and break or crack under loading in extreme cold temperatures, unlike traditional WRSV with elastomer seals.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A method of using a wireline retrievable safety valve (WRSV) for carbon capture, comprising:

deploying a WRSV into a tubing retrievable safety valve (TRSV), wherein the WRSV comprises a first actuator coupled to a first valve element disposed in a first valve body, the TRSV comprises a second valve element disposed in a second valve body;

operating the first actuator to move the first valve element between a closed position and an open position, wherein operating the first actuator comprises controlling a pressure of a fluid chamber to move a piston coupled to the first valve element;

delivering an injection fluid through the WRSV and the TRSV in the open position of the first valve element of the WRSV; and sealing the piston of the first actuator of the WRSV via one or more metal-to-metal seals.

2. The method of claim 1, wherein delivering the injection fluid comprises delivering carbon dioxide and exposing the WRSV to a temperature as low as −78° C., and sealing the piston of the first actuator of the WRSV via the one or more metal-to-metal seals comprises maintaining the sealing of the WRSV at the temperature as low as −78° C.

3. The method of claim 1, wherein the one or more metal-to-metal seals comprises a first metal-to-metal seal between the piston and a down stop configured to stop a movement of the piston at an end of a range of axial movement of the piston.

4. The method of claim 3, wherein the one or more metal-to-metal seals comprise a second metal-to-metal seal on an outer surface of the piston in contact with an inner surface of the fluid chamber.

5. The method of claim 4, wherein the second metal-to-metal seal comprises a metal spring energized (MSE) seal and a MSE backup ring.

6. The method of claim 3, wherein the first metal-to-metal seal comprises a first sloped surface on an outer surface of the piston in contact with a second sloped surface on the down stop.

7. The method of claim 1, wherein operating the first actuator to move the first valve element between the closed position and the open position comprises bypassing operation of the second valve element of the TRSV.

8. The method of claim 7, wherein bypassing operation of the second valve element of the TRSV comprises disabling a functioning state of the TRSV.

9. The method of claim 7, wherein bypassing operation of the second valve element of the TRSV comprises maintaining operation via the WRSV during a failed state of the TRSV.

10. The method of claim 1, comprising sealing an outer surface of the first valve body of the WRSV within an inner surface of the second valve body of the TRSV via one or more non-elastomeric seals.

11. The method of claim 10, wherein the one or more non-elastomeric seals comprise an additional metal-to-metal seal, a thermoplastic seal, or any combination thereof.

12. The method of claim 1, wherein operating the first actuator comprises moving the piston to move a flow tube extending between the piston and the first valve element, the flow tube driving movement of the first valve element between the closed position and the open position.

13. The method of claim 12, wherein delivering the injection fluid comprises routing the injection fluid through a bore in the WRSV, the piston is disposed outside of the bore, and the flow tube is disposed about the bore.

14. The method of claim 13, wherein operating the first actuator comprises moving the piston while operating a mechanical spring that provides an axial biasing force against the piston, wherein the mechanical spring is disposed about the flow tube between the piston and the first valve element.

15. A system, comprising:

a wireline retrievable safety valve (WRSV) for carbon capture, comprising:

a first valve body;

a first valve element disposed in the first valve body; and a first actuator disposed in the first valve body and coupled to the first valve element, wherein the WRSV is configured to deploy into a tubing retrievable safety valve (TRSV) comprising a second valve element disposed in a second valve body, wherein the first actuator is configured to move the first valve element between a closed position and an open position, wherein the first actuator comprises:

a fluid chamber;

a piston coupled to the first valve element, wherein the first actuator is configured to control a pressure of the fluid chamber to move the piston and the first valve element, wherein the WRSV is configured to deliver an injection fluid through the WRSV and the TRSV in the open position of the first valve element of the WRSV; and one or more metal-to-metal seals that seal the piston of the first actuator of the WRSV.

16. The system of claim 15, wherein the one or more metal-to-metal seals comprises a first metal-to-metal seal between the piston and a down stop configured to stop a movement of the piston at an end of a range of axial movement of the piston, and a second metal-to-metal seal on an outer surface of the piston in contact with an inner surface of the fluid chamber.

17. The system of claim 15, wherein the first actuator comprises:

a flow tube extending between the piston and the first valve element, wherein the flow tube is configured to drive movement of the first valve element between the closed position and the open position in response to movement of the piston; and a mechanical spring disposed about the flow tube between the piston and the first valve element, wherein the mechanical spring is configured to provide an axial biasing force against the piston, the first valve element comprises a flapper valve, a fluid flow path of the injection fluid passes through a bore in the WRSV, the piston is disposed outside of the bore, and the flow tube is disposed about the bore.

18. A method of using a wireline retrievable safety valve (WRSV) for carbon capture, comprising:

deploying a WRSV into a tubing retrievable safety valve (TRSV), wherein the WRSV comprises a first actuator coupled to a first valve element disposed in a first valve body, the TRSV comprises a second valve element disposed in a second valve body;

operating the first actuator to move the first valve element between a closed position and an open position and bypassing operation of the second valve element of the TRSV, wherein operating the first actuator comprises controlling a pressure of a fluid chamber to move a piston coupled to the first valve element;

delivering an injection fluid comprising carbon dioxide through the WRSV and the TRSV in the open position of the first valve element of the WRSV, wherein the injection fluid exposes the WRSV to a temperature as low as −78° C.; and sealing the piston of the first actuator of the WRSV via one or more seals without any elastomeric seals, wherein the one or more seals maintain the sealing at the temperature as low as −78° C.

19. The method of claim 18, wherein the one or more seals comprise a first metal-to-metal seal between the piston and a down stop configured to stop a movement of the piston at an end of a range of axial movement of the piston, and a second metal-to-metal seal on an outer surface of the piston in contact with an inner surface of the fluid chamber.

20. The method of claim 18, wherein bypassing operation of the second valve element of the TRSV comprises disabling a functioning state of the TRSV, maintaining operation via the WRSV during a failed state of the TRSV, or any combination thereof.

* * * * *